US008820211B1

(12) United States Patent
Hawbaker

(10) Patent No.: US 8,820,211 B1
(45) Date of Patent: Sep. 2, 2014

(54) SELECTABLE DUAL MODE TRIGGER FOR SEMIAUTOMATIC FIREARMS

(71) Applicant: Peter Jonathan Hawbaker, Fairbanks, AK (US)

(72) Inventor: Peter Jonathan Hawbaker, Fairbanks, AK (US)

( * ) Notice: Subject to any disclaimer, the term of this patent is extended or adjusted under 35 U.S.C. 154(b) by 0 days.

(21) Appl. No.: 14/152,894

(22) Filed: Jan. 10, 2014

Related U.S. Application Data

(62) Division of application No. 13/714,453, filed on Dec. 14, 2012, now Pat. No. 8,667,881.

(51) Int. Cl.
*F41A 19/00* (2006.01)

(52) U.S. Cl.
USPC ..... 89/139; 42/69.01

(58) Field of Classification Search
USPC ..... 42/69.01–69.03; 89/129.01, 131, 136, 89/139
See application file for complete search history.

(56) References Cited

U.S. PATENT DOCUMENTS

| | | | | |
|---|---|---|---|---|
| 3,292,492 | A * | 12/1966 | Sturtevant | 89/128 |
| 4,693,170 | A * | 9/1987 | Atchisson | 89/149 |
| 6,615,527 | B1 * | 9/2003 | Martin | 42/69.03 |
| 6,966,138 | B1 * | 11/2005 | Deckard | 42/69.01 |
| 8,112,928 | B2 * | 2/2012 | Keough | 42/69.03 |

* cited by examiner

*Primary Examiner* — Gabriel Klein

(57) ABSTRACT

One embodiment of a trigger system with an integral selector for semi-automatic firearms. A selector allows the user to choose between two modes and rates of fire. A trigger (1) is made to allow passage of the lower portion of a selector cam (5) to the exterior of the firearm. A selector lever (6) is affixed to the lower end of the selector cam (5) on the exterior of the firearms action. Turning the selector lever (6) rotates the selector cam (5) which tilts a pivotal disconnector (3) on its axis, varying the amount of disconnector (3) engagement with a hammer (2). The variance in the disconnector (3) engagement causes the firearm to fire in one of two modes, firing one round with a trigger pull and resetting with trigger release, or firing one round with trigger pull, and firing another round with trigger release. Other embodiments are described.

4 Claims, 9 Drawing Sheets

SELECTABLE DUAL MODE TRIGGER FOR SEMIAUTOMATIC FIREARMS

CROSS-REFERENCE TO RELATED APPLICATIONS

This application claims the benefit of nonprovisional patent application Ser. No. 13/714,453 filed 2012 Dec. 14 by the present inventor.

BACKGROUND

Prior Art

The following is a tabulation of some prior art that presently appears relevant:

| U.S. patents | | |
|---|---|---|
| patent No. | Issue Date | Patentee |
| 4,344,351 | Aug. 17, 1982 | McQueen |
| 4,514,923 | May 7, 1985 | Teel |
| 4,685,379 | Aug. 11, 1987 | Troncoso |
| 4,787,288 | Nov. 29, 1988 | Miller |
| 5,074,190 | Dec. 24, 1991 | Troncoso |
| 6,101,918 | Aug. 15, 2000 | Akins |
| 6,966,138 | Nov. 22, 2005 | Deckard |

Semi-automatic firearms have a limited firing rate as compared to automatic weapons. Automatic weapons are also known to be prohibitively expensive and harder to acquire than semi-automatic firearms. As a result many devices have been proposed in the past for increasing the firing rate of semi-automatic firearms. See for example, U.S. Pat. No. 4,344,351 to McQueen; U.S. Pat. No. 4,787,288 to Miller; U.S. Pat. Nos. 4,803,910 and 5,074,190 to Troncoso; U.S. Pat. No. 6,101,918 to Akins; and U.S. Pat. No. 6,966,138 to Deckard.

Some of these solutions attempt to make it easier to "bump fire", or use the firearms recoil to allow user to manipulate trigger faster, but these solutions fail to meet the needs of the industry because of complicated non-intuitive operation or undesirable add on devices. Other solutions attempt to use mechanical means such as crank or slide devices to manipulate trigger quickly, but these solutions are similarly unable to meet the needs of the industry because non-intuitive operation with difficulty maintaining accurate fire. Still other solutions, for example U.S. Pat. No. 6,966,138 to Deckard, seek to convert a standard trigger to fire a shot on both pull and release, but these solutions also fail to meet industry needs because the device needs to be installed and removed to switch between modes of operation, and are not compatible with trigger systems with a forward hammer engagement surface such as AR-15 and AR-10 pattern rifles, one of the most popular rifles in the United States.

Deckard's device also has no means of eliminating the possibility of "hammer follow" in the double-fire mode. In the double fire mode, if the trigger is not manipulated properly, the hammer can follow the bolt assembly forward as it reciprocates resulting in either multiple rounds fired with one function of the trigger or the hammer being in a forward (fired) position with a loaded round in the chamber.

In the double fire mode of Deckard's device, the primary sear surface of the trigger and the disconnector engagement surface are spaced so that if the trigger is improperly manipulated or held in a central position, the hammer will not be held in a rearward position. The hammer will follow the bolt assembly forward, resulting in the aforementioned automatic fire or requiring manually reciprocating the bolt assembly to resume firing. This is a serious shortcoming of the device, as it is capable of firing more than one round with a single function of the trigger thus meeting the definition of a machine gun as described in 26 U.S.C. 5845(b), in which a machine gun is defined as a weapon which is able to fire more than one shot with a single function of the trigger. Thus this device would not gain approval by the Bureau of Alcohol, Tobacco, Firearms and Explosives Firearms Technology Branch for civilian sales.

Thus, the need exists for solutions to the above problems with prior art.

SUMMARY

The present invention is a selectable trigger for semiautomatic firearms, enabling quick and easy transitions between two modes and rates of fire. One mode allows normal semi-automatic operation, in which the firearm fires one round with a pull of the trigger and resets trigger with release of trigger, and another mode which fires a round with a pull of the trigger and fires another round with trigger release, thus doubling rate of fire.

In one embodiment the invention comprises of the following core components: A trigger, a primary disconnector, a secondary disconnector, a hammer, a selector cam, a selector lever, a detent spring and detent ball. These components are connected as follows: The selector cam is positioned under the front of the primary disconnector. The shaft of the selector cam passes through the trigger. The selector lever is fastened to the bottom of the selector cam by a cross pin. A spring and detent ball are located in the selector lever and engage voids in the trigger to keep selector lever in desired position.

When the selector lever is turned, the selector cam engages the primary disconnector, tilting the primary disconnector on its axis, thus varying the amount of engagement of the primary disconnector on the hammer.

With the selector in first position, the firearm will function as most semiautomatic firearms function, a pull of the trigger will fire one round, releasing the trigger will reset the trigger for the next shot. In this mode, the primary disconnector engagement will not release hammer until the engagement surface of trigger or trigger mechanism is in position to retain hammer in a cocked position.

With the selector in the second position, the firearm will fire one round when the trigger is pulled, and fire one round when trigger is released, thus doubling rate of fire. In this mode, the primary disconnector engagement depth is lessened, allowing the hammer to be released before the engagement surface of the trigger or trigger mechanism is in place to retain hammer in a cocked position, thus allowing hammer to fall striking firing pin, firing a round.

The secondary disconnector prevents the hammer from following the bolt assembly forward if the engagement surface of the trigger or the primary disconnector is not in position to retain hammer in a cocked rearward position. If the trigger is either forward or rearward the secondary disconnector will not engage the hammer, but if the trigger is in a central position that would allow the hammer to follow the bolt forward, the secondary disconnector will engage hammer retaining it in a rearward position until the trigger is either pulled or released.

ADVANTAGES

The present invention advantageously fills the aforementioned deficiencies by providing a selectable dual mode trigger for semiautomatic firearms which provides the user the ability to quickly and easily transition between two modes of operation, one mode doubling the rate of fire as opposed to a conventional trigger system. The invention requires no installation or removal of devices to transition between modes of operation, a simple flip of a switch is all that is required to transition between modes of operation.

The inventions secondary disconnector is advantageous in that the possibility of hammer follow is eliminated. The secondary disconnector greatly enhances the reliability of the trigger system, as well as prevents more than one round being fired per trigger function, thus meeting BATFE restrictions.

The invention is advantageous in that it is a mechanical device, and does not depend on the recoil of the weapon to function, as some prior art devices do. It will function equally well on firearms chambered for high or low recoil rounds.

The present invention is advantageous over prior art in that its operation in both modes is intuitive, with no unusual manipulations or motions required to operate. The device operates with a pull and a release of the trigger, in the same manner as practically every other firearm. The selector lever is unobtrusive, and does not hinder normal operation, handling, or function.

The present invention is advantageous in that it is compatible with trigger systems with a forward hammer engagement surface, such as the popular AR-15 and AR-10 pattern rifles or any semi-automatic firearm using or able to be adapted to use such a trigger system.

FIGURES

REFERENCE NUMERALS

Figure 1:
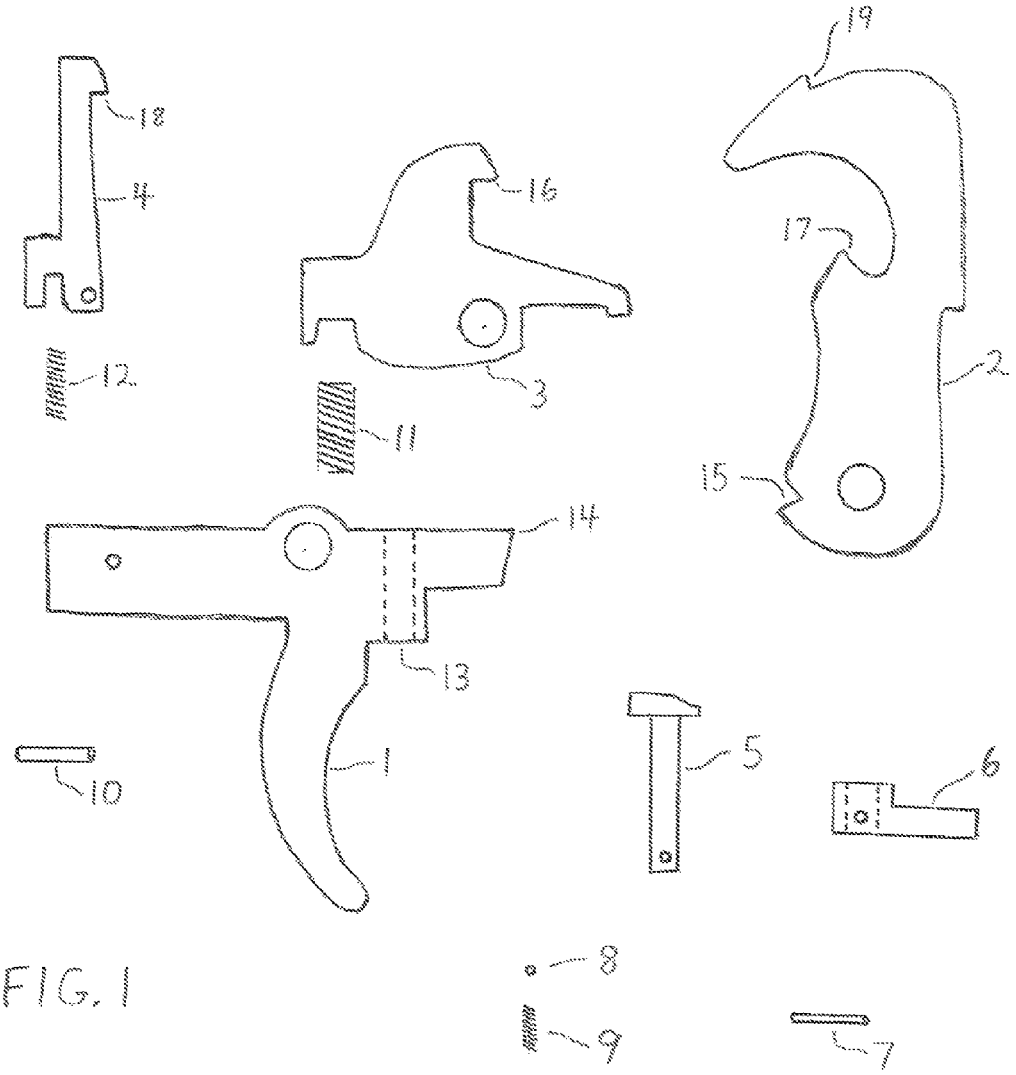
FIG. 1 shows the individual components of the invention in accordance with the first embodiment in a disassembled state.

1 trigger
2 hammer
3 primary disconnector
4 secondary disconnector
5 selector cam
6 selector lever
7 selector pin
8 selector detent
9 selector detent spring
10 secondary disconnector pin
11 primary disconnector spring
12 secondary disconnector spring
13 selector cam bore
14 hammer engagement surface of trigger
15 trigger engagement surface of hammer
16 hammer engagement surface of primary disconnector
17 primary disconnector engagement surface of hammer
18 hammer engagement surface of secondary disconnector
19 secondary disconnector engagement surface of hammer
20 raised camming surface of selector cam
21 safety selector (prior art)
22 second position selector detent recess
23 first position selector detent recess
24 hammer pin (prior art)
25 trigger and primary disconnector pin (prior art)
26 selector detent bore

DETAILED DESCRIPTION

FIGS. 1-16

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

The core components of the selectable dual mode trigger are illustrated in FIG. 1. A trigger 1 is manufactured with a selector cam bore 13 in which a selector cam 5 fits, with its shaft protruding from the bottom of the trigger 1.

Affixed to the lower portion of selector cam 5 by means of a selector pin 7 is a selector lever 6. A selector detent 8 and a selector detent spring 9 fit inside the selector lever 6. The trigger 1 has a slot in its top portion to fit a primary disconnector 3, a primary disconnector spring 11, a secondary disconnector 4, and a secondary disconnector spring 12. A secondary disconnector pin 10 is used to retain the secondary disconnector 4 in the trigger 1. A hammer 2 is equipped with engagement surfaces 15, 17, and 19 for the trigger 1, primary disconnector 3, and the secondary disconnector 4 respectively.

Figure 2:
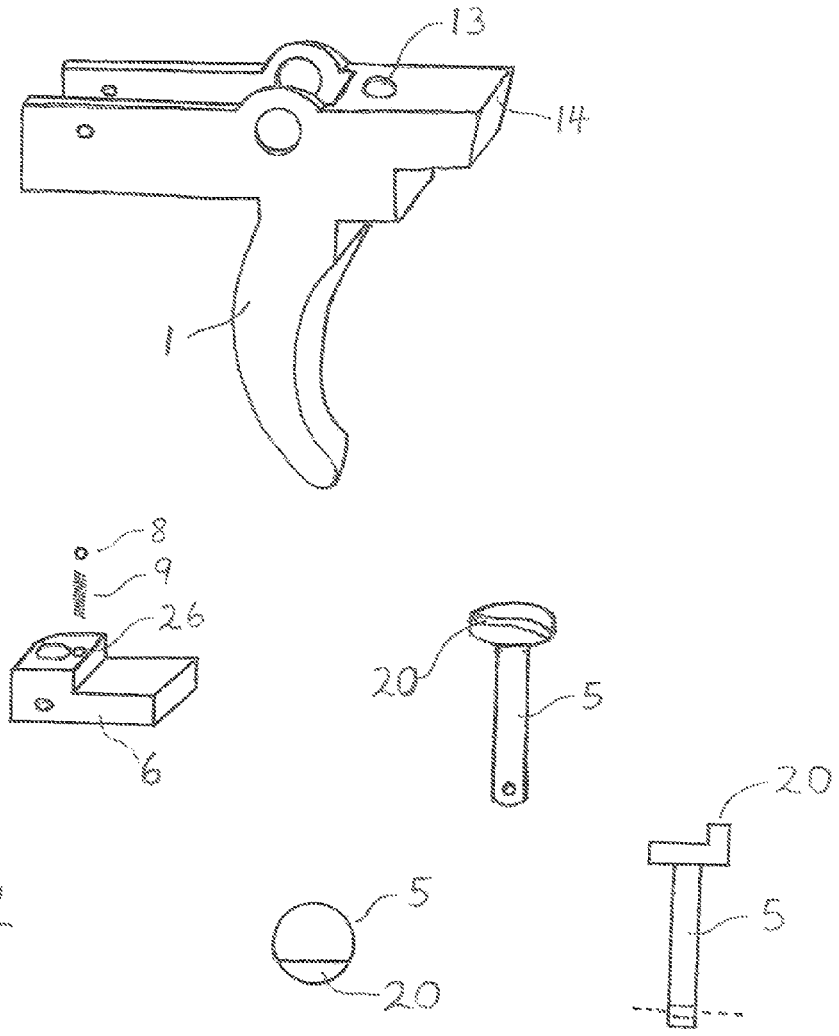
FIG. 2 shows various aspects and details of the trigger, selector lever, detent, detent spring and selector cam.

Alternative views of the trigger 1, the selector lever 6, and the selector cam 5 are shown in FIG. 2. In this view, the top of the selector cam bore 13 is visible on the upper surface of the trigger 1. This view shows a selector detent bore 26 in the top surface of the selector lever 6 in which the selector detent spring 9 and selector detent 8 fit. Three different aspect views of the selector cam 5 show in detail a raised camming surface 20. The raised camming surface 20 interfaces with the primary disconnector 3 when the selector lever 6 is in the second position.

Figure 3:
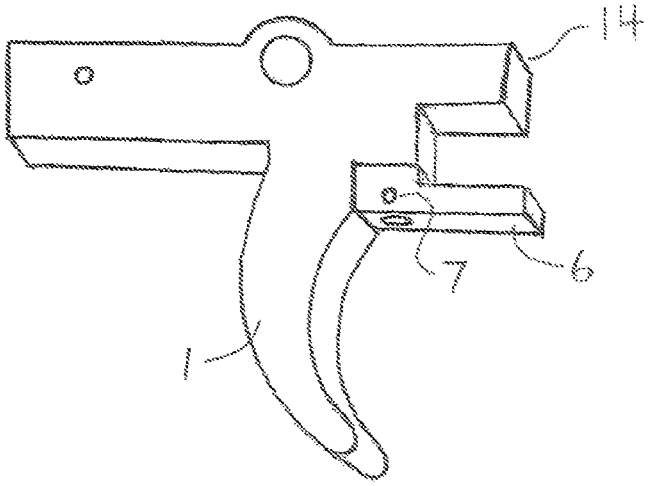
FIG. 3 shows another aspect of the trigger, selector lever, and selector pin, showing the selector lever in the first position, allowing normal semi-automatic operation.

The selector lever 6 is shown in the first position in FIG. 3. In this position, the firearm will function as a normal semi-automatic, firing one shot with trigger pull, and resetting trigger with trigger release. Also visible in FIG. 3 is the selector pin 7.

Figure 4:
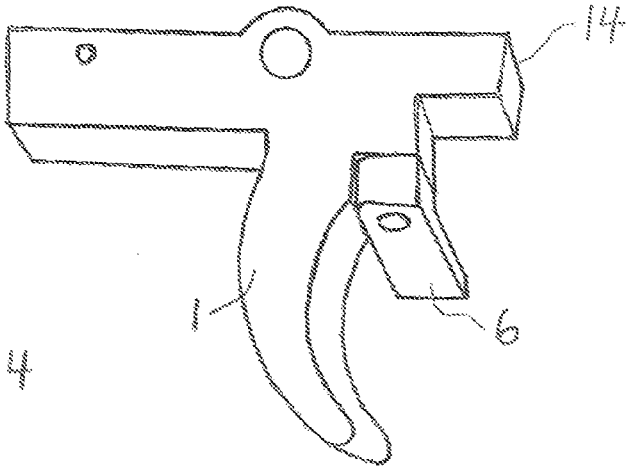
FIG. 4 shows another aspect of the trigger and selector lever with the selector lever in the second position, allowing a dual mode of fire with firearm firing one shot on trigger pull, and firing one shot on trigger release.

The selector lever 6 is shown in the second position in FIG. 4. The selector lever 6 rotates 90 degrees to transition between the two modes of fire. In the second position, the firearm will fire one round with trigger pull, and fire one round with trigger release. This mode of operation doubles the rate of fire as compared to normal semi-automatic operation.

Figure 5:
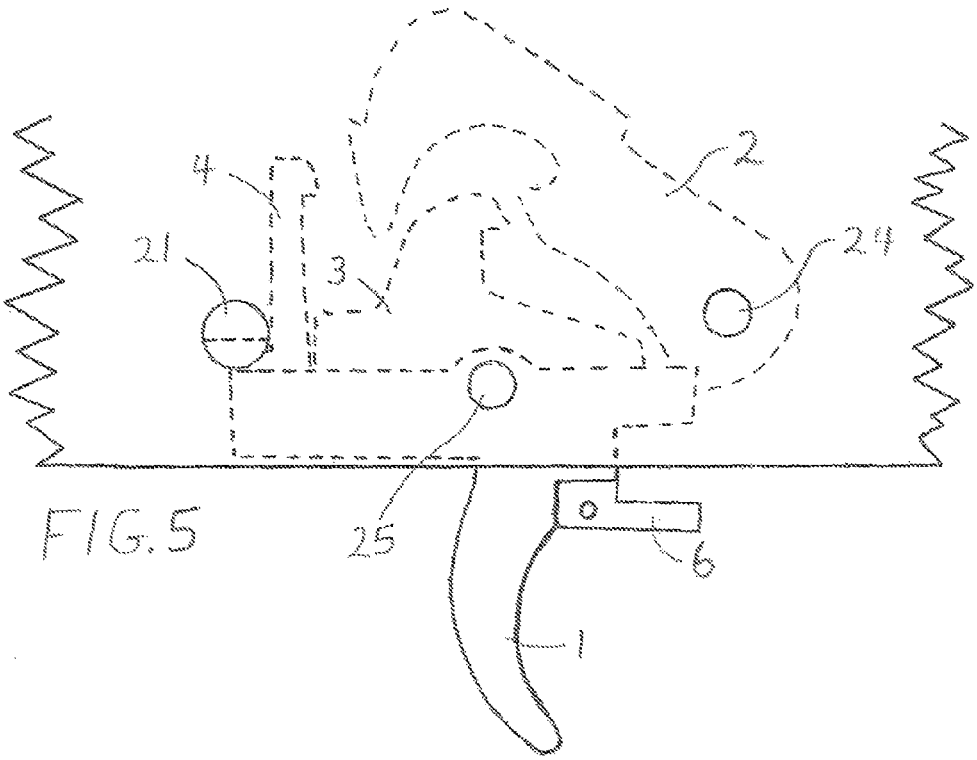
FIG. 5 shows various components of the invention in relation to the receiver or trigger housing of a firearm, with the trigger and selector lever protruding exposed allowing manipulation.

In FIG. 5 various components of the selectable dual mode trigger are shown in relation to the firearms receiver or trigger housing. The curved portion of the trigger 1 and the selector lever 6 are exposed allowing manipulation to fire the weapon and to select between two modes of operation. The trigger 1 and the primary disconnector 3 pivot on a trigger and primary disconnector pin 25. The hammer 2 pivots on a hammer pin 24. A safety selector 21 serves as a static contact point for the secondary disconnector 4 during the firing cycle of the selectable dual mode trigger.

Figure 6:
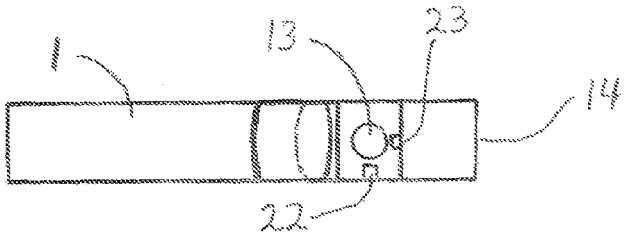
FIG. 6 shows another aspect, an underside view, of the trigger showing selector cam bore and recesses for detent engagement.

The underside of the trigger 1 is shown in FIG. 6. Visible from this perspective are the selector cam bore 13, a first position selector detent recess 23, and a second position selector detent recess 22.

Figure 7:
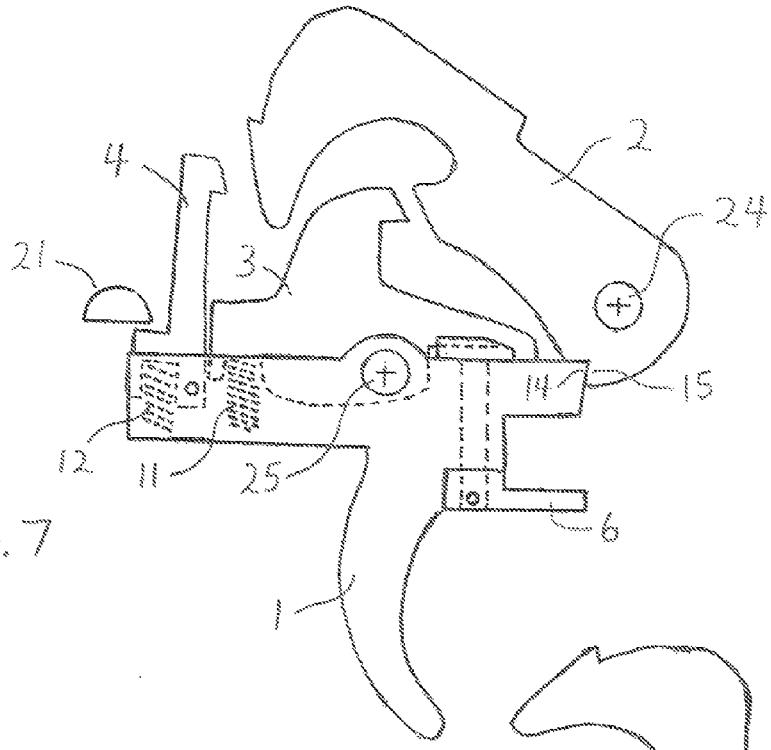
FIG. 7 shows the dual mode trigger in the forward position with the hammer in the cocked rearward position and the selector lever in the first position for normal semi-automatic operation.

FIG. 7 shows the selectable dual mode trigger cocked ready to fire. The selector lever 6 is placed in the first position to allow normal semi-automatic operation. The trigger 1 is in a forward position. The hammer 2 is retained in a cocked rearward position by the hammer engagement surface of the trigger 14. The primary disconnector is pushed in a forward position by the primary disconnector spring 11. The secondary disconnector 4 is pushed in a forward position by the secondary disconnector spring 12. The secondary disconnector 4 is not contacting the safety selector 21.

Figure 8:
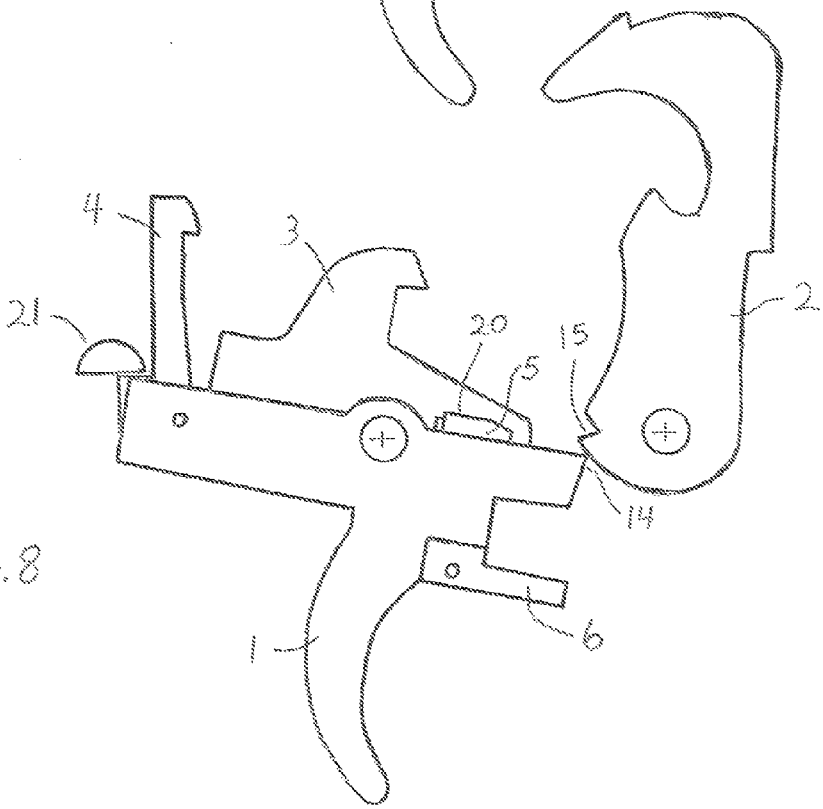
FIG. 8 shows the dual mode trigger in rearward position with the hammer in the forward fired position and the selector lever in the first position for normal semi-automatic operation.

FIG. 8 shows the trigger 1 pulled rearward, disengaging the hammer engagement surface of the trigger 14 from the trigger engagement surface of the hammer 15. This allows the hammer 2 to pivot forward, firing a round. The selector lever 6 is in the first position. The selector cam 5 is visible above the trigger 1. The raised camming surface of the selector cam 20 is positioned beside the primary disconnector 3. The secondary disconnector 4 is in contact with the safety selector 21 and is pivoted rearward.

Figure 9:
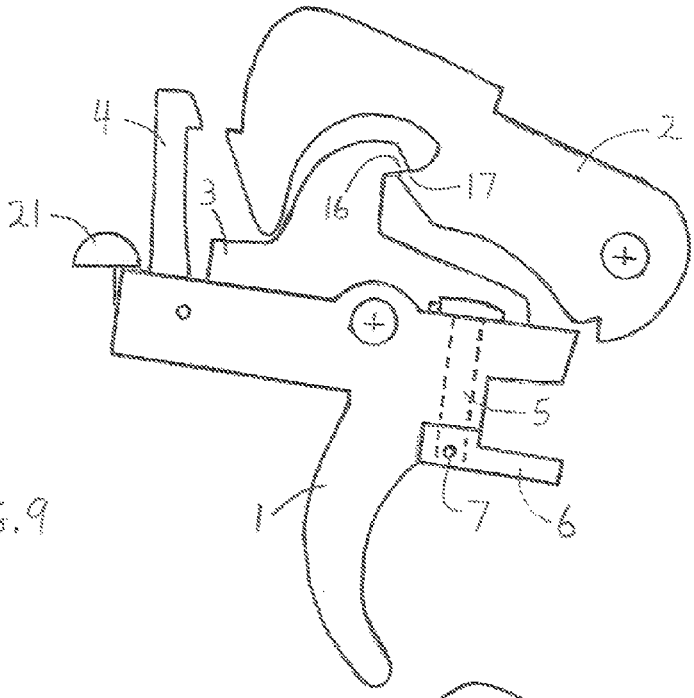
FIG. 9 shows the dual mode trigger in the rearward position with the hammer in rearward position with the hammer being held rearward by the primary disconnector and the selector lever in the first position to allow normal semi-automatic operation.

FIG. 9 shows the trigger 1 in a rearward position being held there by the users finger immediately after a shot is fired. The selector lever 6 is in the first position. The hammer 2 has been returned to a rearward position by the firearms action, and is retained in that position by the primary disconnector 3. The secondary disconnector 4 is in contact with the safety selector 21 and is in a rearward position.

Figure 10:
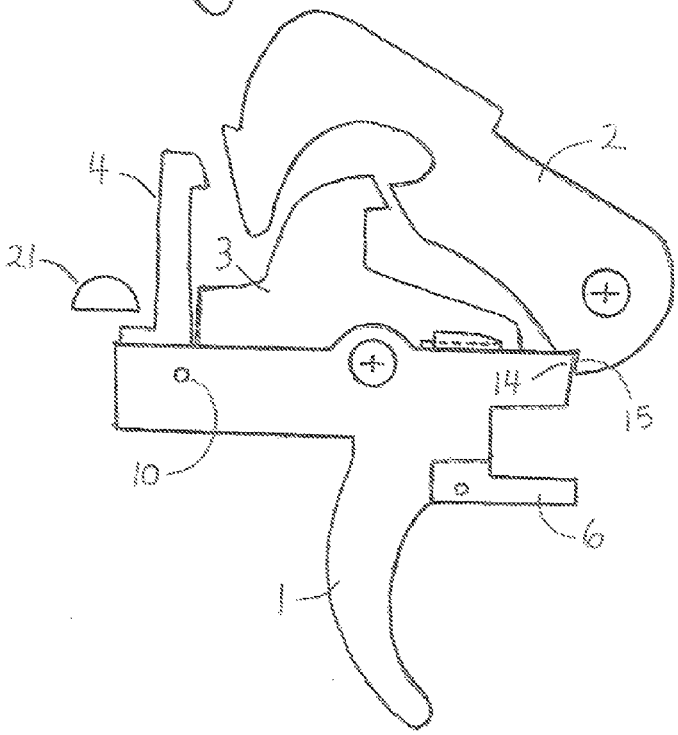
FIG. 10 shows the dual mode trigger returned to the forward position with the hammer in the cocked rearward position and the selector lever in the first position for normal semi-automatic operation.

FIG. 10 shows the trigger 1 released by the operator and returned to a forward position. The hammer 2 has been released by the primary disconnector 3 and is now being held in a cocked rearward position by the hammer engagement surface of the trigger 14. The selector lever 6 is in the first position. The secondary disconnector 4 is in the forward position, no longer in contact with the safety selector 21.

FIGS. 7-10 detail one cycle of the selectable dual mode trigger with the selector lever 6 in the first position. The firearm fired one round when the trigger 1 was pulled rearward by the operator, and the hammer 2 reset in a cocked rearward position when the operator released the trigger 1. This is the normal semi-automatic mode of operation. The hammer 2 is in a cocked position ready to fire another round with the pull of the trigger 1.

Figure 11:
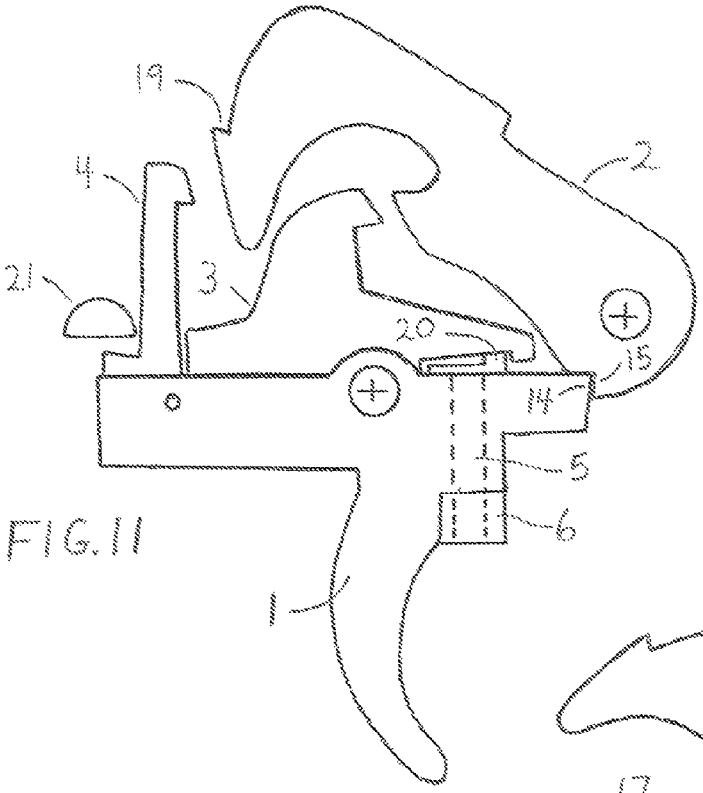
FIG. 11 shows the dual mode trigger in the forward position with the hammer in the cocked rearward position and the selector lever in the second position to allow a shot to be fired both with trigger pull and trigger release.

FIG. 11 shows the dual mode trigger with the trigger 1 in the forward position. The hammer 2 is in a cocked rearward position retained in that position by the hammer engagement surface of the trigger 14. The selector lever 6 has been rotated 90 degrees and is now in the second position. The selector cam 5 has likewise rotated 90 degrees and the raised camming surface of the selector cam 20 is positioned under the front of the primary disconnector 3. The raised camming surface of the selector cam 20 tilts the primary disconnector 3 rearward about 0.030".

Figure 12:
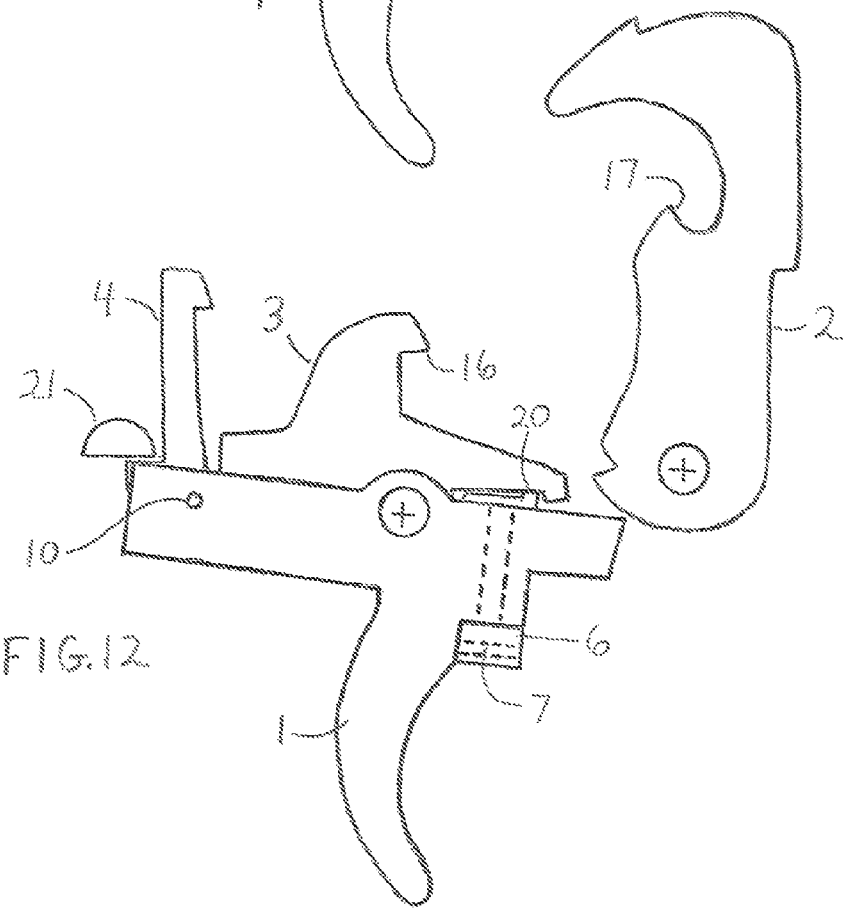
FIG. 12 shows the dual mode trigger in the rearward position with the hammer in the forward fired position and the selector lever in the second position to allow a shot to be fired both with trigger pull and trigger release.

FIG. 12 shows the trigger 1 pulled rearward by the operator. The hammer 2 has rotated forward, firing a round. The selector lever 6 is in the second position. The primary disconnector 3 is tilted rearward about 0.030" in relation to the trigger 1. The secondary disconnector 4 is in contact with the safety selector 21 and is tilted rearward.

Figure 13:
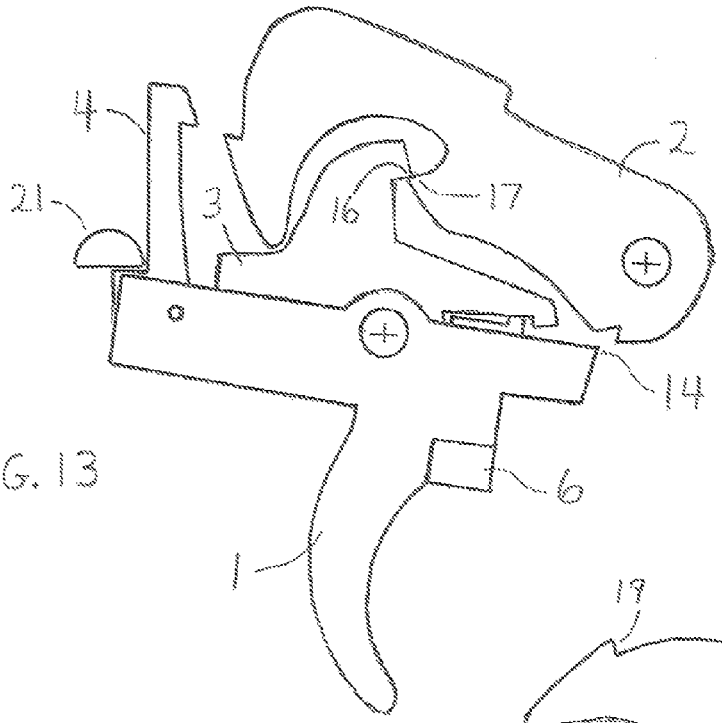
FIG. 13 shows the dual mode trigger in the rearward position with the hammer in the rearward position being held rearward by the primary disconnector and the selector lever in the second position to allow a shot to be fired both with trigger pull and trigger release.

FIG. 13 shows the trigger 1 held in a rearward position by the operator immediately after firing a round. The hammer 2 has been returned to a rearward position by the firearms action and is retained in that rearward position by the primary disconnector 3.

Figure 14:
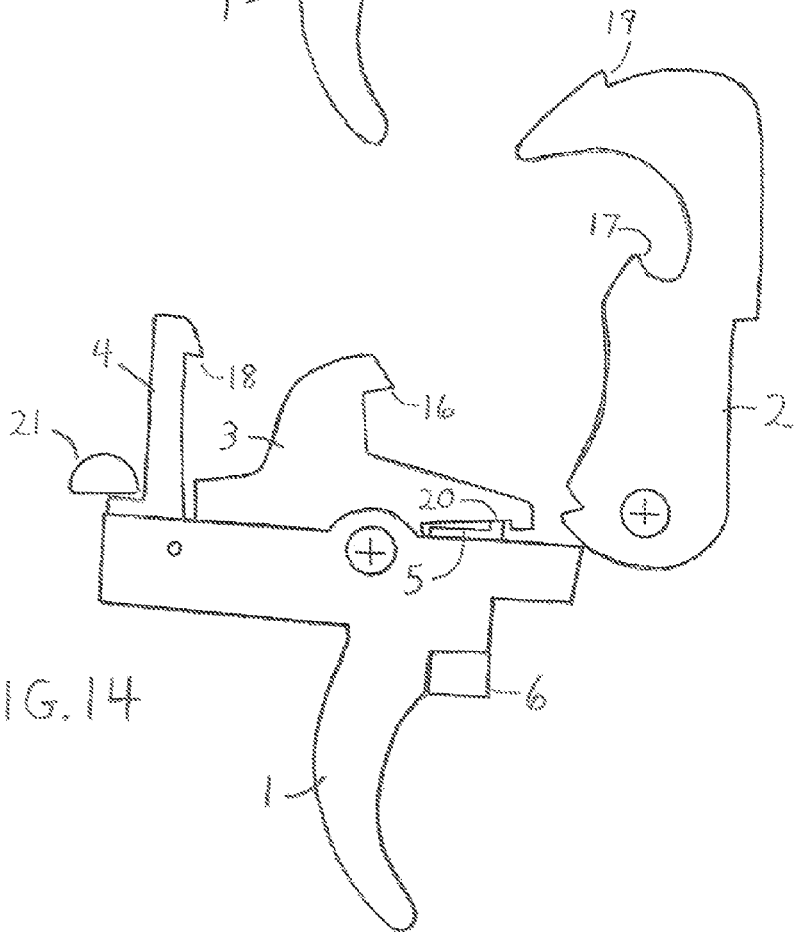
FIG. 14 shows the dual mode trigger in the central position with the hammer in the forward fired position having been released by the primary disconnector and the selector lever in the second position to allow a shot to be fired both with trigger pull and trigger release.

FIG. 14 shows the trigger 1 in a central position having been released by the operator. The selector lever 6 is in the second position and the primary disconnector 3 is tilted rearward about 0.030" in relation to the trigger 1. As a result of the primary disconnector 3 being tilted rearward by the raised camming surface of the selector cam 20, the hammer engagement surface of the primary disconnector 16 is rearward about 0.030" and releases the hammer 2 before the hammer engagement surface of the trigger 14 is in position to retain it in a rearward position. As a result, instead of the hammer 2 resetting as it does when the selector lever 6 is in the first position, the hammer 2 rotates forward firing a round. Thus, two rounds are fired in one rearward and forward cycle of the trigger 1 accomplishing a rate of fire double that of standard semi-automatic firearms.

Figure 15:
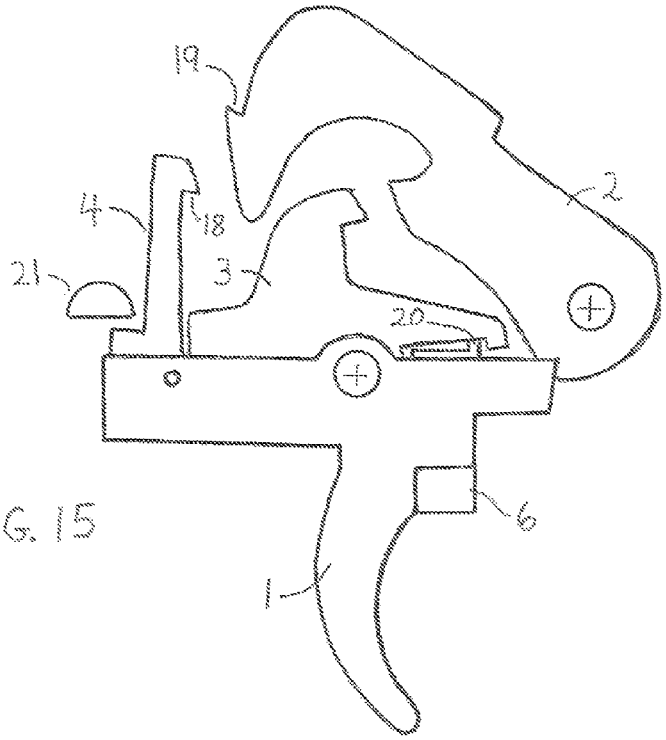
FIG. 15 shows the dual mode trigger returned to the forward position with the hammer in the rearward cocked position and the selector lever in the second position to allow a shot to be fired both with trigger pull and trigger release.

FIG. 15 shows the trigger 1 released by the operator in the forward position. The selector lever 6 is in the second position. The hammer 2 has been returned to a rearward position by the action of the firearm. It is retained in the rearward cocked position by the hammer engagement surface of the trigger 14. One rearward and forward (pull and release) cycle of the trigger 1 has now been completed resulting in the firing of two rounds, one shot on pull, one shot on release.

Figure 16:
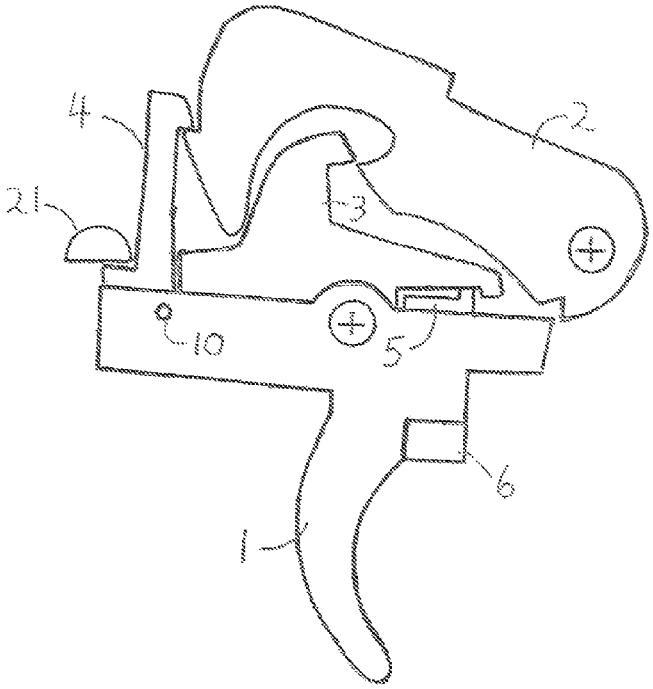
FIG. 16 shows the dual mode trigger in the central position with the hammer in the rearward position being held rearward by the secondary disconnector and the selector lever in the second position to allow a shot to be fired both with trigger pull and release.

FIG. 16 illustrates the essential and novel function of the secondary disconnector 4. When the selector lever 6 is in the second position, the primary disconnector 3 is tilted rearward about 0.030" in relation to the trigger 1. In this mode of operation, in which the firearm fires a round both with pull and release of trigger 1, it is possible that neither the hammer engagement surface of the primary disconnector 16 or the hammer engagement surface of the trigger 14 will be in position to retain the hammer 2 when it is returned rearward by the firearms action. This possibility exists if the trigger 1 is in a central position, neither forward nor rearward completely.

In this scenario, the secondary disconnector 4 will retain the hammer 2 in a rearward position, preventing the hammer 2 from following the action or bolt forward. If the hammer 2 is retained in a rearward position by the secondary disconnector 4, a complete pull or release of the trigger 1 will release the hammer 2. If the trigger 1 is pulled to a rearward position, the secondary disconnector 4 will contact the safety selector 21 which tilts the secondary disconnector 4 rearward, causing the hammer engagement surface of the secondary disconnector 18 to disengage with the hammer 2. The hammer 2 will then move forward slightly before being retained in a rearward position by the primary disconnector 3 as illustrated in FIG. 13.

If the hammer 2 is retained in a rearward position by the secondary disconnector 4 as illustrated in FIG. 16 and the trigger 1 is released to a forward position by the operator, the secondary disconnector 4 will move rearward in relation to the hammer 2 and the hammer engagement surface of the secondary disconnector 18 will disengage the hammer 2. The hammer 2 will then rotate forward slightly and be retained in a rearward position by the hammer engagement surface of the trigger 14 as illustrated in FIG. 15.

In use, the operator chooses which mode of operation he desires to fire the weapon in and rotates the selector lever 6 accordingly. The operator then pulls and releases the trigger 1. In the first mode the firearm will discharge one round with each complete pull and release of the trigger 1, in the second mode the firearm will discharge two rounds with each complete pull and release of the trigger 1.

The trigger 1, hammer 2, selector cam 5, primary disconnector 3, and secondary disconnector 4 are constructed of hardened firearms grade tool steel. The selector lever 6 can be constructed of various materials including but not limited to aluminum alloys, mild steel, hardened steel, or various composites.

While the invention has been described, disclosed, illustrated, and shown in one embodiment, the scope of the invention is not intended to be, nor should it be deemed to be, limited thereby and such other modifications or embodiments as may be suggested by the teachings herein are particularly reserved especially if they fall within the scope of the claims here appended. Other embodiments could use other means of selectively varying the engagement of the primary disconnector such as a sliding or pivoting selector. The secondary disconnector could use a static point of contact other than the safety selector to accomplish disengagement with the hammer. Means other than a detent ball and spring could be implemented to secure the selector lever in the desired position. The invention can include additional features as desired, such as but not limited to a checkered, grooved or resilient surface on the selector lever.

ADVANTAGES

From the description above, a number of advantages of my selectable dual mode trigger for semiautomatic firearms become evident.

(a) The selector lever is unobtrusive and fits close to the receiver or trigger housing of the firearm.

(b) The selector lever allows easy transition between two modes and rates of fire without the addition or deletion of any devices or attachments.

(c) The selectable dual mode trigger can be installed in many firearms, such as AR-15 and AR-10 pattern rifles with no modification to the receiver or other major components of the firearm.

(d) The secondary disconnector retains the hammer in a rearward position if the trigger is in a central position, yet releases the hammer if the trigger is either pulled or released completely, preventing automatic fire or hammer follow malfunctions.

(e) The selectable dual mode trigger is mechanical and functions equally well on high or low recoil firearms, unlike many other devices for increasing rate of fire which are dependent on a firearms recoil to function.

(f) The selectable dual mode trigger is intuitive to use, the operator simply pulls and releases the trigger in both modes of fire, as in virtually every other firearm.

(g) The selectable dual mode trigger functions in both modes while the operator has a firm, natural grasp of the firearm which increases accuracy and control.

(h) Although other devices are add on and external, making them susceptible to damage and contamination with debris, the selectable dual mode trigger's components are contained inside the firearm thus increasing reliability and safety.

(i) The selectable dual mode trigger increases the rate of fire of a semiautomatic firearm without being classified as a machine gun or restricted weapon.

CONCLUSION, RAMIFICATIONS, AND SCOPE

Accordingly, the reader will see that the selectable dual mode trigger can be used to quickly and easily transition between two modes and rates of fire. The selectable dual mode trigger allows rates of fire approaching that of fully automatic firearms without the disadvantages of other proposed devices. Unlike other devices proposed to increase rate of fire, it is unobtrusive and requires no special techniques to operate. The selectable dual mode trigger is compatible with firearms and trigger systems with a forward hammer engagement surface, such as the popular AR-15 type firearms.

Although the description above contains many specificities, these should not be construed as limiting the scope of the embodiments, but providing illustrations of one embodiment. For example, the various components such as the trigger, hammer, disconnectors, selector lever and cam can have different shapes, the trigger can have a separate sear, the secondary disconnector can have alternative means of releasing hammer, etc.

Thus the scope of the embodiments should be determined by the appended claims and their legal equivalents, rather than by the examples given.

I claim:

1. An integral movable device for a firearm, which retains a pivotal hammer in a cocked position when a trigger is in a central position, defined between a fully rearward pulled position and a fully forward released position, in which neither a trigger sear surface nor a pivotal disconnector is in position to retain said pivotal hammer upon its return to the cocked position by an action of the firearm, comprising: a spring-biased secondary disconnector with a hammer engagement surface which engages a corresponding engagement surface on said pivotal hammer, said secondary disconnector having a surface which contacts a component of the firearm to force said secondary disconnector to release the hammer from the cocked position when the trigger is pulled fully rearward, said secondary disconnector holding said pivotal hammer in the cocked position when the firearm's action is in battery until said trigger is pulled fully rearward from the central position, causing said pivotal hammer to be released by said secondary disconnector and engaged by said pivotal disconnector.

2. The movable device of claim 1, wherein said secondary disconnector is attached to the trigger by a pin allowing it to pivot.

3. The movable device of claim 1, wherein the component of the firearm is a static component.

4. The movable device of claim 1, wherein said secondary disconnector further comprises a stop that limits forward travel, forcing said secondary disconnector to release the hammer if the trigger is returned to the fully forward position.

* * * * *